US007726547B2

(12) United States Patent
Tachikawa et al.

(10) Patent No.: US 7,726,547 B2
(45) Date of Patent: Jun. 1, 2010

(54) PHOTOPRINT STORAGE BAG

(75) Inventors: Kimiko Tachikawa, Tokyo (JP); Shigeaki Ueyama, Tokyo (JP)

(73) Assignee: Fujifilm Corporation, Tokyo (JP)

( * ) Notice: Subject to any disclaimer, the term of this patent is extended or adjusted under 35 U.S.C. 154(b) by 1356 days.

(21) Appl. No.: 11/151,265

(22) Filed: Jun. 14, 2005

(65) Prior Publication Data

US 2005/0274777 A1 Dec. 15, 2005

(30) Foreign Application Priority Data

Jun. 15, 2004 (JP) ..... 2004-177011

(51) Int. Cl.
*B65D 27/00* (2006.01)
*B42D 15/00* (2006.01)

(52) U.S. Cl. ..... 229/68.1; 229/67.3; 229/92.8; 229/928

(58) Field of Classification Search ..... 229/68.1, 229/71, 82, 84, 928, 67.3, 92.8; 40/124.06, 40/124.16, 124.19
See application file for complete search history.

(56) References Cited

U.S. PATENT DOCUMENTS 966,383 A * 8/1910 Cooke ..... 229/82
1,106,058 A * 8/1914 Rand ..... 229/92.8
1,194,440 A * 8/1916 Swortfiguer ..... 229/67.3
1,632,185 A * 6/1927 Jenner ..... 248/459
2,390,864 A * 12/1945 Bayley ..... 229/72
2,782,542 A * 2/1957 Blevens ..... 40/754
3,370,781 A * 2/1968 Sroge ..... 229/71
4,244,511 A * 1/1981 Coleman ..... 229/92.1
4,531,316 A * 7/1985 Farnum ..... 40/777
5,133,496 A * 7/1992 Davidson et al. ..... 229/92.8
5,226,532 A * 7/1993 Davidson et al. ..... 206/232
5,337,949 A * 8/1994 Seeley ..... 229/92.8
5,678,756 A * 10/1997 Sugiura ..... 229/313
6,045,035 A * 4/2000 Murakami et al. ..... 229/84
6,427,371 B2 * 8/2002 Olson et al. ..... 40/789
6,578,757 B1 * 6/2003 Espenshied et al. ..... 229/92.8
6,694,657 B2 * 2/2004 Tsao ..... 40/789

FOREIGN PATENT DOCUMENTS

JP 11-292086 A 10/1999

* cited by examiner

*Primary Examiner*—Jes F Pascua
(74) *Attorney, Agent, or Firm*—Birch, Stewart, Kolasch & Birch, LLP

(57) ABSTRACT

The present invention provides a multifunction and low-cost photoprint storage bag. When paper is die-cut along a pattern to produce development sheets, folds are created simultaneously, thereby achieving simple manufacturing. A multifunction photoprint storage bag can be realized by folding along folds on the die-cut development sheet, which is used as a photoprint storage bag and a photo stand, and further as a sealed letter by folding back in the opposite direction.

4 Claims, 10 Drawing Sheets

PHOTOPRINT STORAGE BAG

BACKGROUND OF THE INVENTION

1. Field of the Invention

The present invention relates to a photoprint storage bag that stores a photoprint.

2. Description of the Related Art

When a user goes to a photo developing shop (DPE shop: Development Printing and Enlargement shop) or the like to receive photographs, they are usually handed to the user in a storage bag for storing photoprints. Some techniques aim to provide multifunction photoprint storage bags. For example, Japanese Patent Application Publication No. 11-292086 provides a photoprint storage bag capable of storing an index print in order to help user readily order re-printing.

Incidentally, there is a demad for low-cost production in manufacturing such photoprint storage bags. In order to achieve low-cost production, the number of manufacturing processes should be minimized. At the same time it is desired to maximize the number of die-cut sheets obtained by die-cutting a material sheet along a paper pattern. In addition, multifunction type of a photoprint storage bag is desired like Japanese Patent Application Publication No. 11-292086.

However, in order to manufacture a photoprint storage bag, many processes are necessary, including: printing process to print patterns on a sheet, die-cutting process to die-cut the printed sheet along the pattern, crease pressing process to make creases on the die-cut sheet (hereafter referred to as a development sheet), and adhesive applying process. The more the number of processes increases, the more production cost rises. In addition, if a margin for applying adhesive is provided on a pattern, a development sheet becomes bigger thereby decreasing the number of development sheets taken from a sheet of material paper and therefore resulting in higher cost. Further, this type of a photoprint storage bag is unlikely to be used for another application other than storing a photoprint.

SUMMARY OF THE INVENTION

The present invention has been made in view of the above circumstances, and provides a multifunction and low-cost photoprint storage bag.

The invention provides a photoprint storage bag that stores a photoprint, wherein a sheet is folded into three in which a central part is superposed by an upper part and a lower part;

the lower part is provided with slits parallel to folds of the central part and the lower part, forming a photoprint storage section by folding inward both ends of the lower part; and the lower part is further provided with cuts into which both lower ends of a photo are inserted, enabling the photoprint storage bag to be used as a photo stand.

According to the photoprint storage bag of the invention, one development sheet is folded into three so that a central part is superposed by an upper part and a lower part, which is provided with slits parallel to folds of the central part and the lower part. Accordingly, a photoprint storage section is formed by folding inward both lower ends of the lower part, saving pasting process when folding a development sheet into a photoprint storage bag, which results in lower manufacturing cost and thus price reduction of a photoprint storage bag. In addition, because the size of the development sheet can be smaller by eliminating a margin for pasting, more development sheets can be die-cut from the material paper, which enhances lower manufacturing cost and then price reduction of a photoprint storage bag. Furthermore, by providing the slits into which lower ends of a photo are inserted, the development sheet can be used as a photo stand, realizing multifunction as a photoprint storage bag and a photo stand.

Since the development sheet is intended to be folded into a photoprint storage bag, folds need to be created on the development sheet. As it is easy to create folds at the same time when the development sheet is die-cut, extra process is not required for creating folds, thereby requiring no additional manufacturing cost.

It is preferred that inward-folding positions of the both ends of the lower part can be freely changed in accordance with the size of a photoprint to be stored.

By providing plural folds, for example, it is possible to fold along any one of the plural folds.

In this way, by providing a folding position or a fold in accordance with the size of a photoprint, the folding position can be changed so that photoprints of various sizes can be stored in the photoprint storage bag.

It is also preferred that cuts in the lower part are formed in accordance with the size of a photoprint medium.

When the photoprint storage bag is used as a photo stand, lower ends of a photo are inserted into the cuts so that pictures with different sizes can be displayed using the photo stand.

Further, it is preferred that the central part is a sealed letter-sized and a cover of a sealed letter is printed on the central part.

If the photoprint storage bag can be used as a sealed letter, it is possible to send the photo enclosed in the sealed letter to another person. Using the sealed letter, a clerk at a photo developing shop can send photoprints to a customer, or a person who took images can send photoprints to another person, for example the person in the photo who wants photoprints.

As mentioned above, it is possible to realize a multifunction and low-cost photoprint storage bag.

BRIEF DESCRIPTION OF THE DRAWINGS

The invention will now be described with reference to the accompanying figures of which:

FIG. 1(*b*) shows a back side of a development view of the photoprint storage bag of the present invention when the bag is developed into a development sheet;

DETAILED DESCRIPTION OF THE INVENTION

An embodiment of the present invention will be described below with reference to the drawings.

Figure 1A:
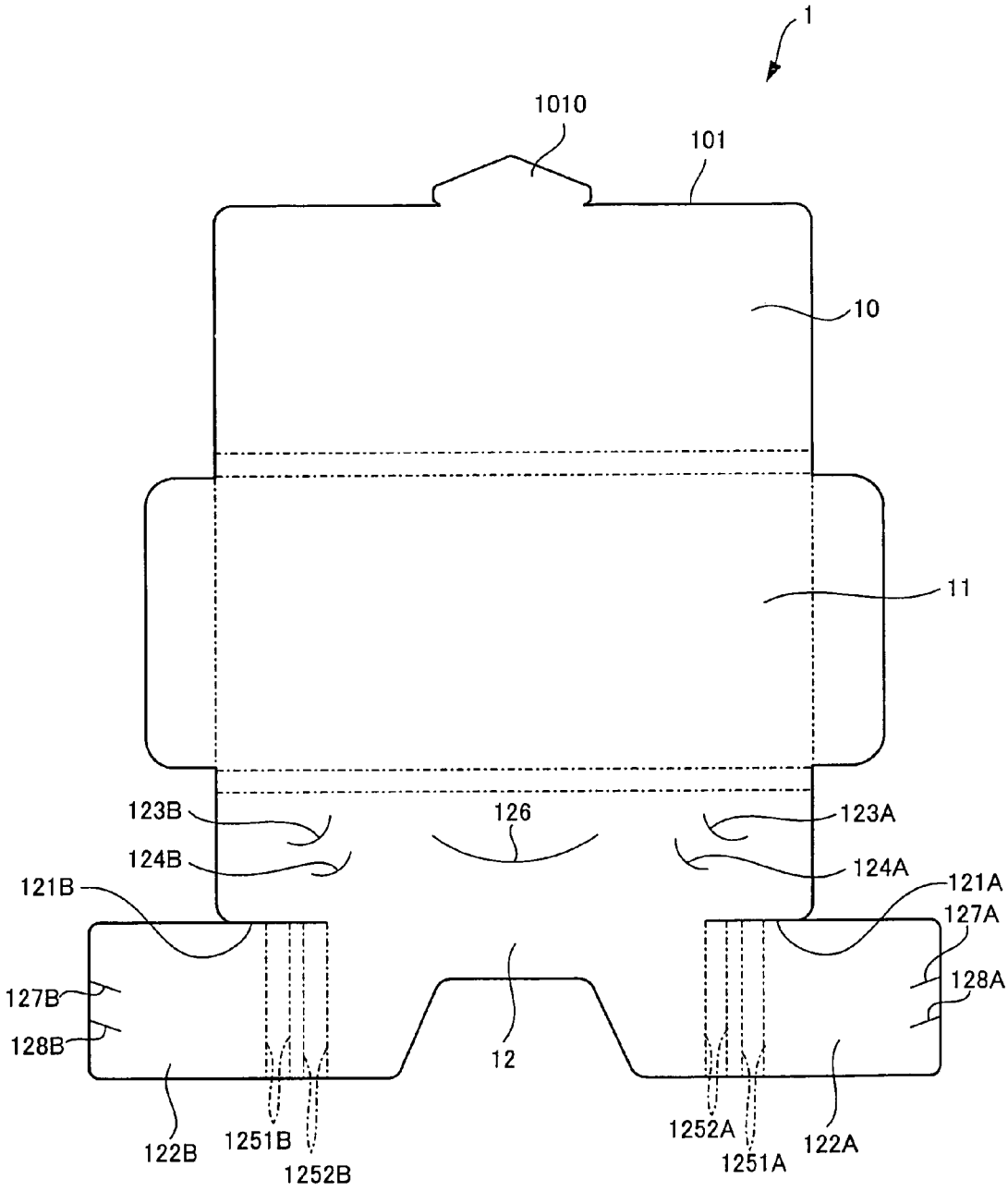
FIG. 1(*a*) shows a front side of a development view of a photoprint storage bag of the present invention when the bag is developed into a development sheet.
Figure 1B:
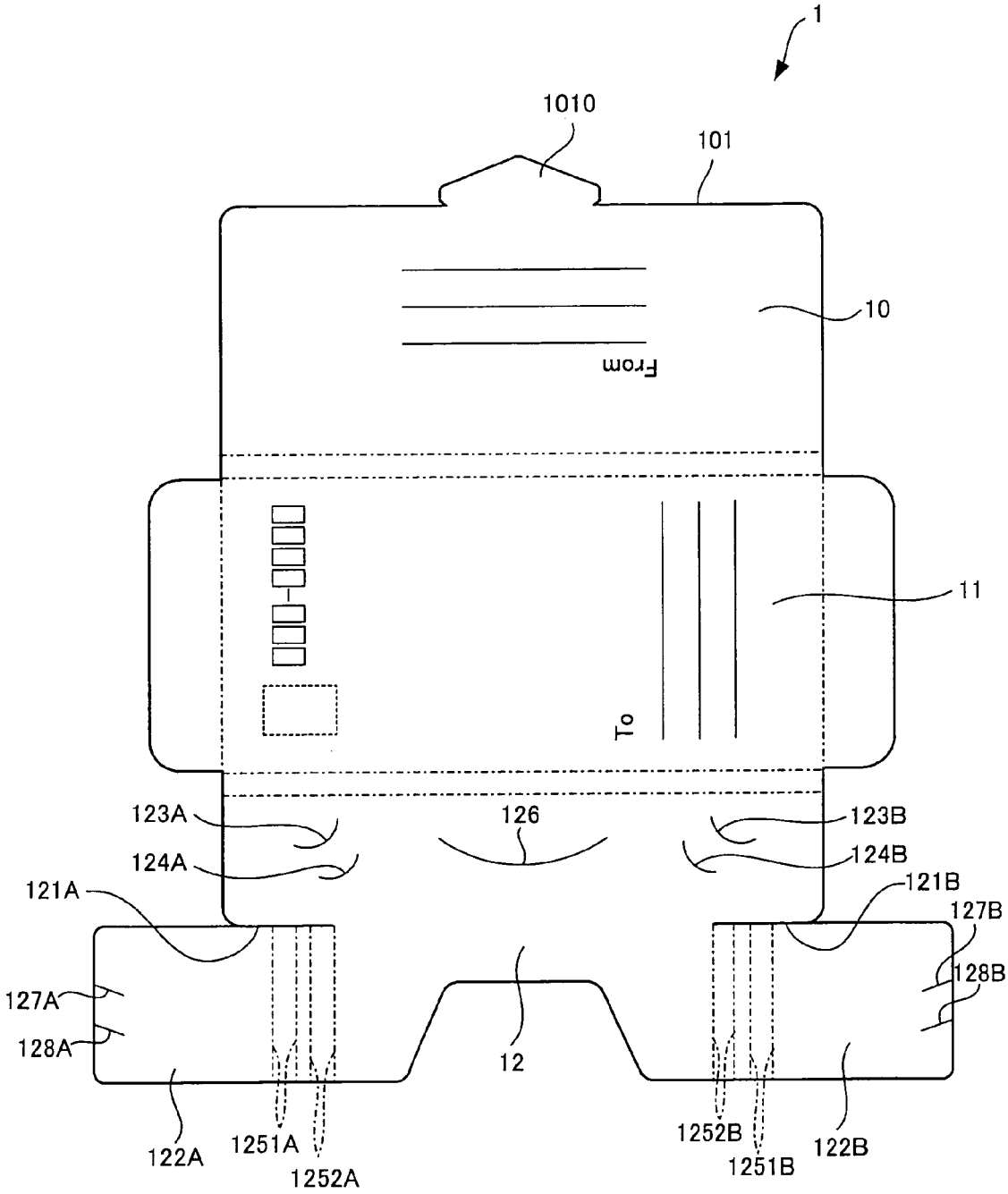

FIG. 1(*a*) and FIG. 1(*b*) show the state in which the photoprint storage bag of the present invention is developed into a development sheet 1.

FIG. 1(*a*) shows the front side of a development sheet and FIG. 1(*b*) shows the back side thereof.

As shown in FIG. 1(*a*) and FIG. 1(*b*), the development sheet 1 is configured in such a way that it is folded into three, so that a central part 11 is superposed by an upper part 10 and a lower part 12. The lower part 12 is provided with slits 121A and 121B which are parallel to folds of the central part 11 and the lower part 12. A photoprint storage section can be formed by folding both ends 122A and 122B inward along folds 1251A and 1251B, or 1252A and 1252B. In addition, the lower part 12 is provided with slits 123A, 123B, 124A, and 124B, so that the photoprint storage bag can be used as a photo stand by inserting the lower edges of a photoprint into the slits. Two kinds of slits respectively corresponding to KG size (postcard size larger than L size) and L size are provided. Also, two kinds of folds corresponding to the two sizes to indicate inward folding position are provided. Accordingly, depending on the size of a photoprint, either KG or L in the embodiment, the photoprint can be stored in the storage section as well as be inserted in the slits to be used as a photo stand, by adjusting a folding position where the lower part of the photoprint storage bag is folded inward and a slit position where the both lower edges of a photoprint are inserted into.

In addition, as the central part is sealed letter-sized and has a printing for the front of a sealed letter on the back thereof, the photoprint storage bag can be used as a sealed letter by folding the upper part 10 and the lower part 12 in a reverse direction in such a way that the front of the sealed letter will be a front cover. In this case, a photoprint storage section is formed by folding the development sheet in a reverse direction of the case where the photoprint storage bag is used as a photo stand or as a photoprint storage bag. The sealed letter is completed, after a photo print is stored in the photo print storage section and then circumference is, for example, pasted.

Figure 2:
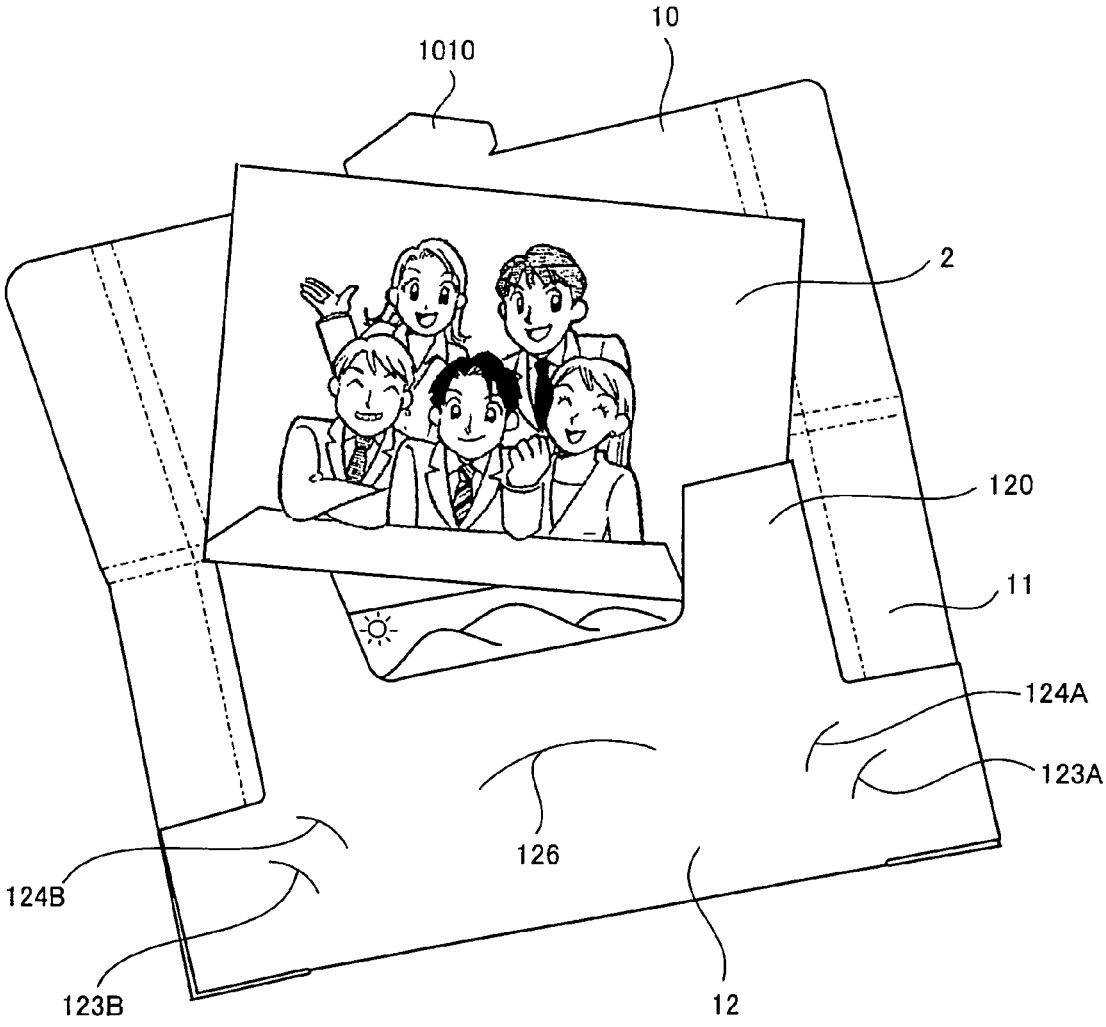
FIG. 2 is an external view of the photoprint storage bag of the present invention when a photoprint storage section is formed.
Figure 3:
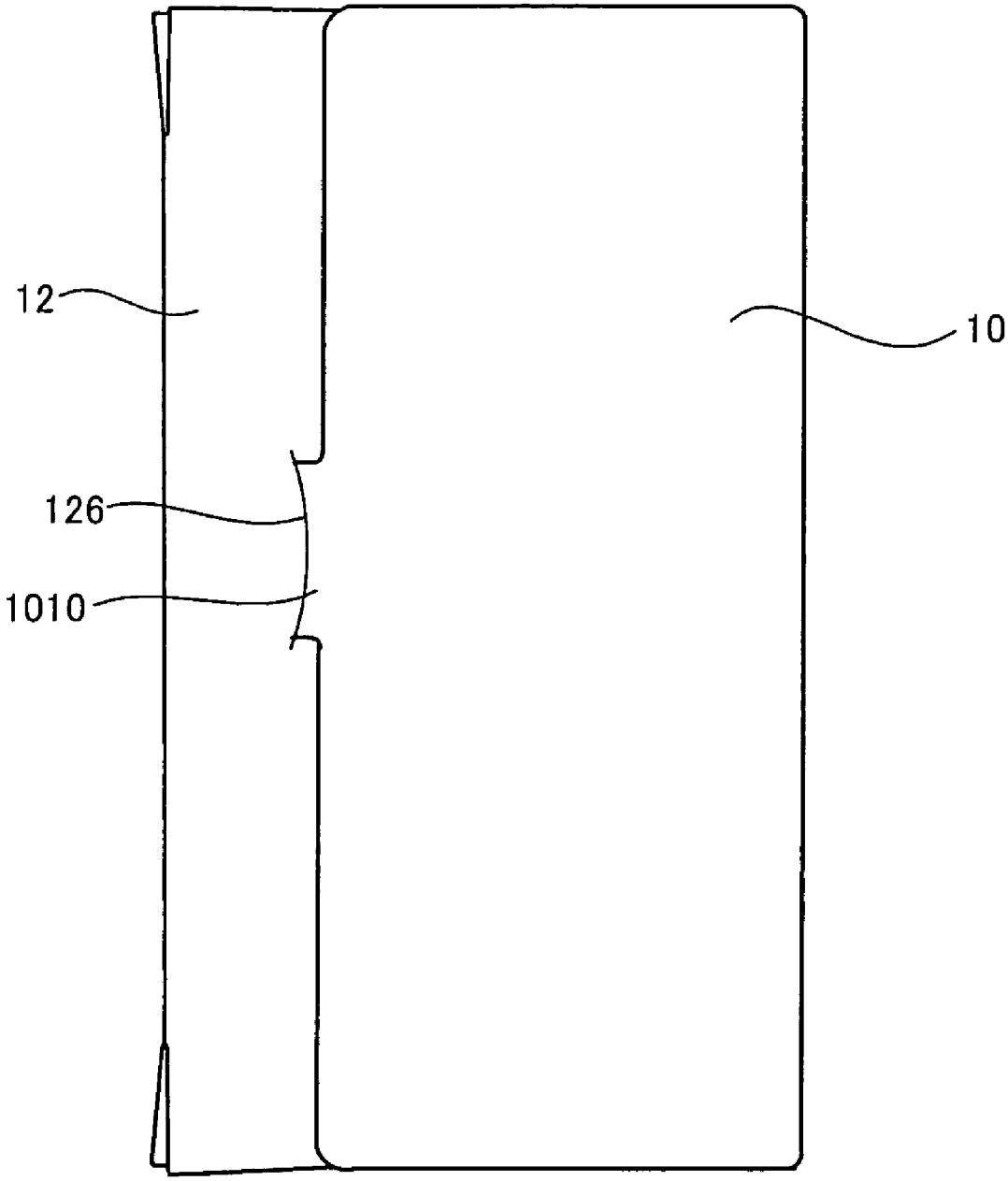
FIG. 3 is an external view of the photoprint storage bag of the present invention when the photoprint storage bag is used as a storage bag.
Figure 4:
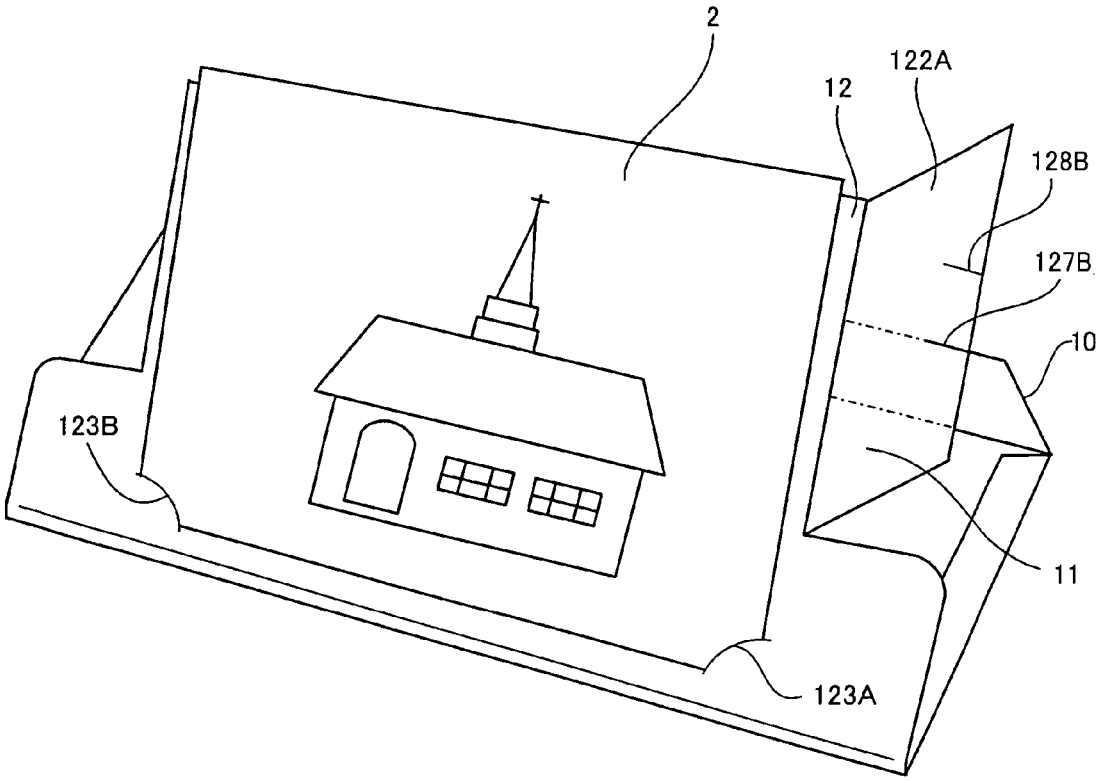
FIG. 4 is an external view of the photoprint storage bag of the present invention when a photo stand is formed.
Figure 5:
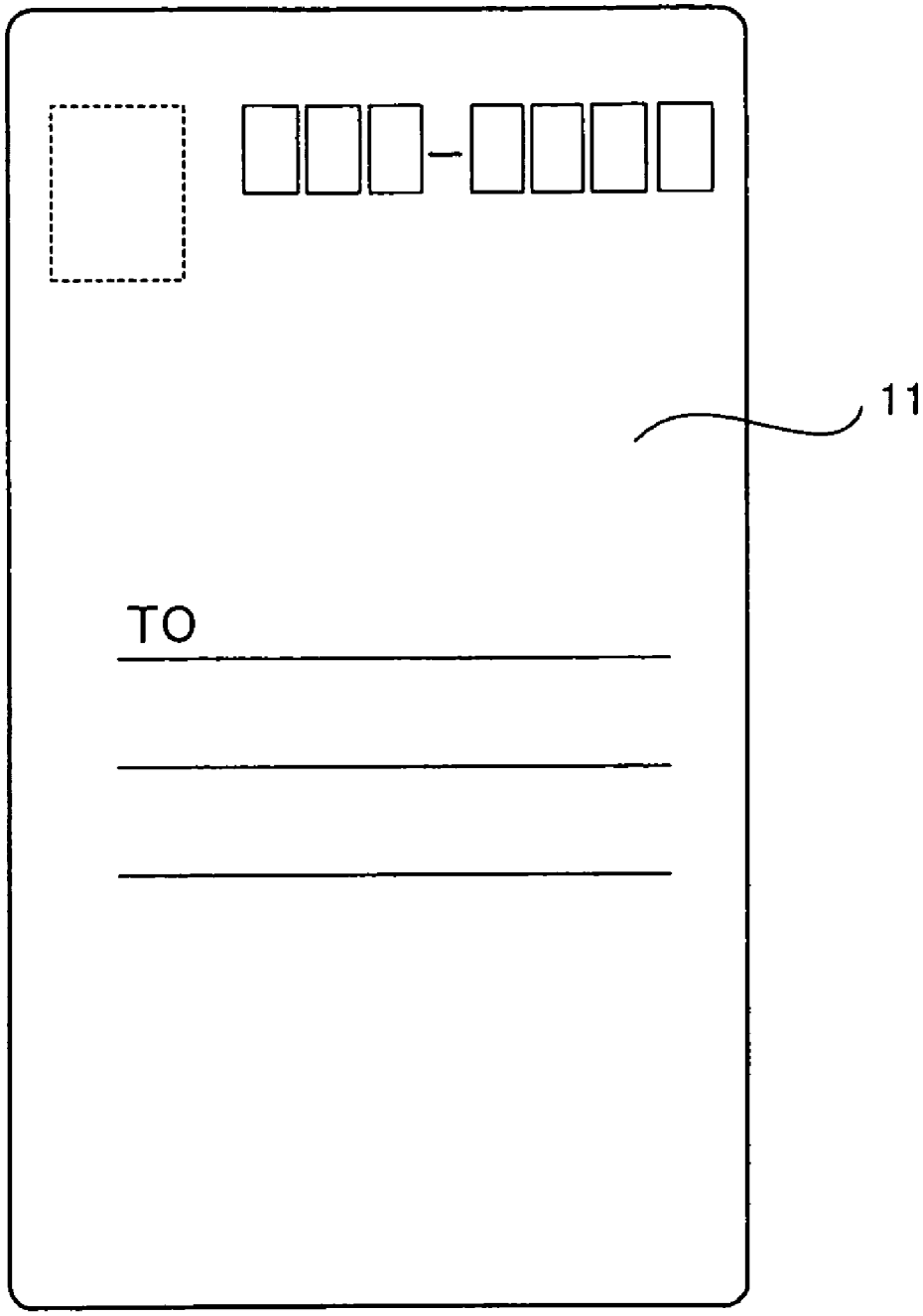
FIG. 5 shows a state when the photoprint storage bag of the present invention is folded into a sealed letter.

FIG. 2 is an external view of the photoprint storage bag of the present invention when a photoprint storage section is formed, FIG. 3 is an external view of the photoprint storage bag of the present invention when the photoprint storage bag is used as a storage bag, FIG. 4 is an external view of the photoprint storage bag of the present invention when the photoprint storage bag is used as a photo stand, and FIG. 5 shows a state when the photoprint storage bag of the present invention is folded into a sealed letter.

FIG. 2 shows the state in which the lower ends 122*a* and 122B are folded inward to form a photoprint storage section and a photo is being stored, FIG. 3 shows the state where insert 1010 of the upper part 10 is inserted into a slit 126 after the photo is stored in the photo print storage section.

When a clerk at a photo developing shop uses the photo print storage bag as a storage bag for example, he or she should form the photoprint storage section 120 by folding the development sheet in a manner as shown in FIG. 2, store photos in the photoprint storage section 120, and insert the insert 1010 into the slit 126 as shown in FIG. 3 in such a way that the photos stored in the photoprint storage section 120 can be sealed. In this way, a photo shop clerk can hand the photoprint storage bag integrally with photoprints to a customer.

In addition, after the customer brings the photoprint storage bag with photoprints back home, he or she can use the photoprint storage bag as a photo stand as shown in FIG. 4.

Further, as the development sheet shown in FIG. 1(*a*) and FIG. 1(*b*) can be folded into a sealed letter, by using the sealed letter, a photo developing shop clerk can send photoprints to a customer who wants the photoprints, or a customer can send photoprints to others.

In this way, a development sheet can be folded into a photoprint storage bag, a photo stand, and further into a sealed letter with photostorage function. In the embodiment, it is proposed that a development sheet 1 is delivered as it is so that it should be folded by a photo developing shop clerk or a customer. This aims to realize cost reduction for manufacturing development sheets because the pasting process at the time of cover binding can be saved, resulting in saving manpower for the process. For the side of users, a multifunction photoprint storage bag is provided as a form of a development sheet. In addition, since the photoprint storage bag can be used also as a sealed letter, a photo developing shop clerk can also provide a new service, utilizing the bag, of sending photoprints to customers who conventionally picked up photos at the shop. Also, the shop can meet the demand responding to the order via the Internet.

In other words, the development sheet in the embodiment has multifunction: a photoprint storage bag for a customer who picks up photos at a shop; a sealed letter for a customer who cannot go to the photo shop; a photo stand after photos are delivered to a customer. A multifunction development sheet can be manufactured without complicate processes, which results in cost reduction with decreased number of manufacturing processes. Therefore, the development sheet provides three functions of a photoprint storage bag, a photo stand, and a sealed letter, exerting excellent performance despite low manufacturing cost.

Lastly, functions of the photoprint storage will be described in an orderly fashion.

Figure 6:
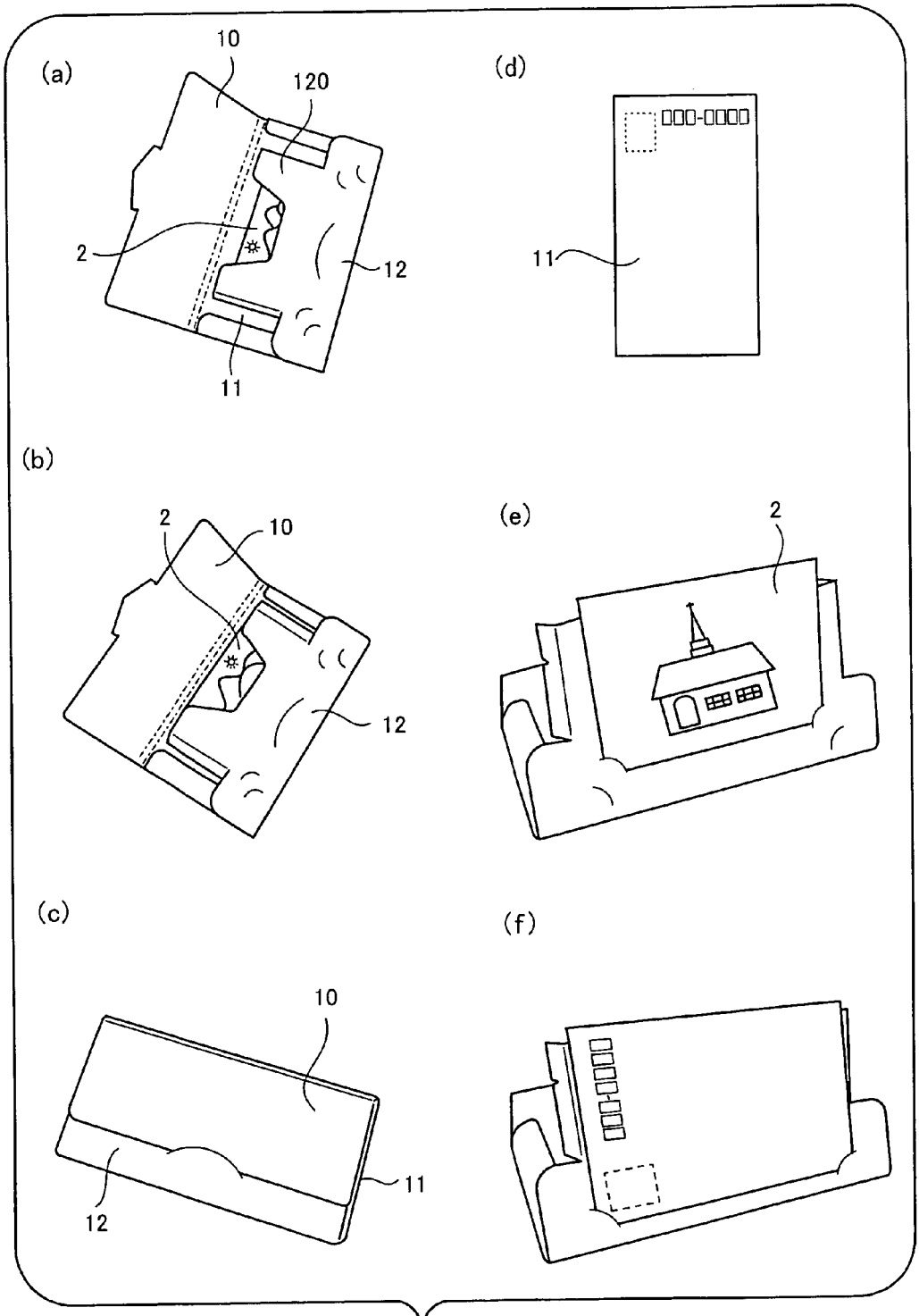
FIG. 6 shows functions of the photoprint storage bag of the present invention in an orderly sequence.

FIG. 6 shows functions of the photoprint storage bag of the present invention in an orderly manner.

Part(a) of FIG. 6 shows the state where an L-sized photo is stored in the photoprint storage section 120; part(b) of FIG. 6 shows the state where a King-sized photo is stored in the photoprint storage section 120; part(c) of FIG. 6 shows the state where the insert 1010 of the upper part is inserted into the slit 126 of the lower part; part(d) of FIG. 6 shows the state where the front of the sealed letter printed on the back of the central part 11 is surfaced by folding the development sheet opposite to that in part (c) of FIG. 6; part(e) shows the state where the photoprint storage bag is used as a photo stand; and part (f) shows the state where the photo stand is used for other application.

In this way, the photoprint storage bag of the present invention can be used for various applications.

Figure 7:
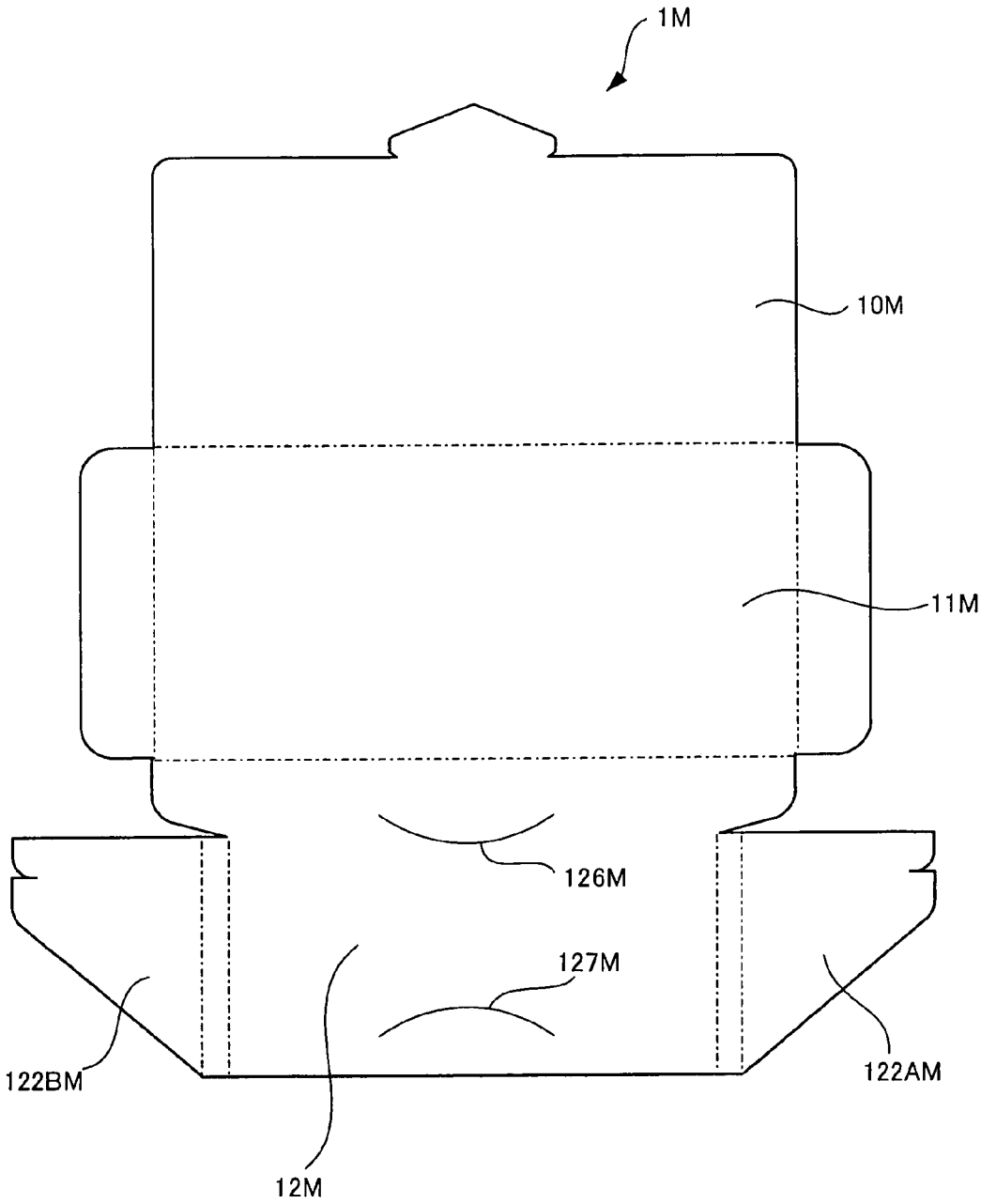
FIG. 7 shows one of variations on the embodiment of the present invention.
Figure 8:
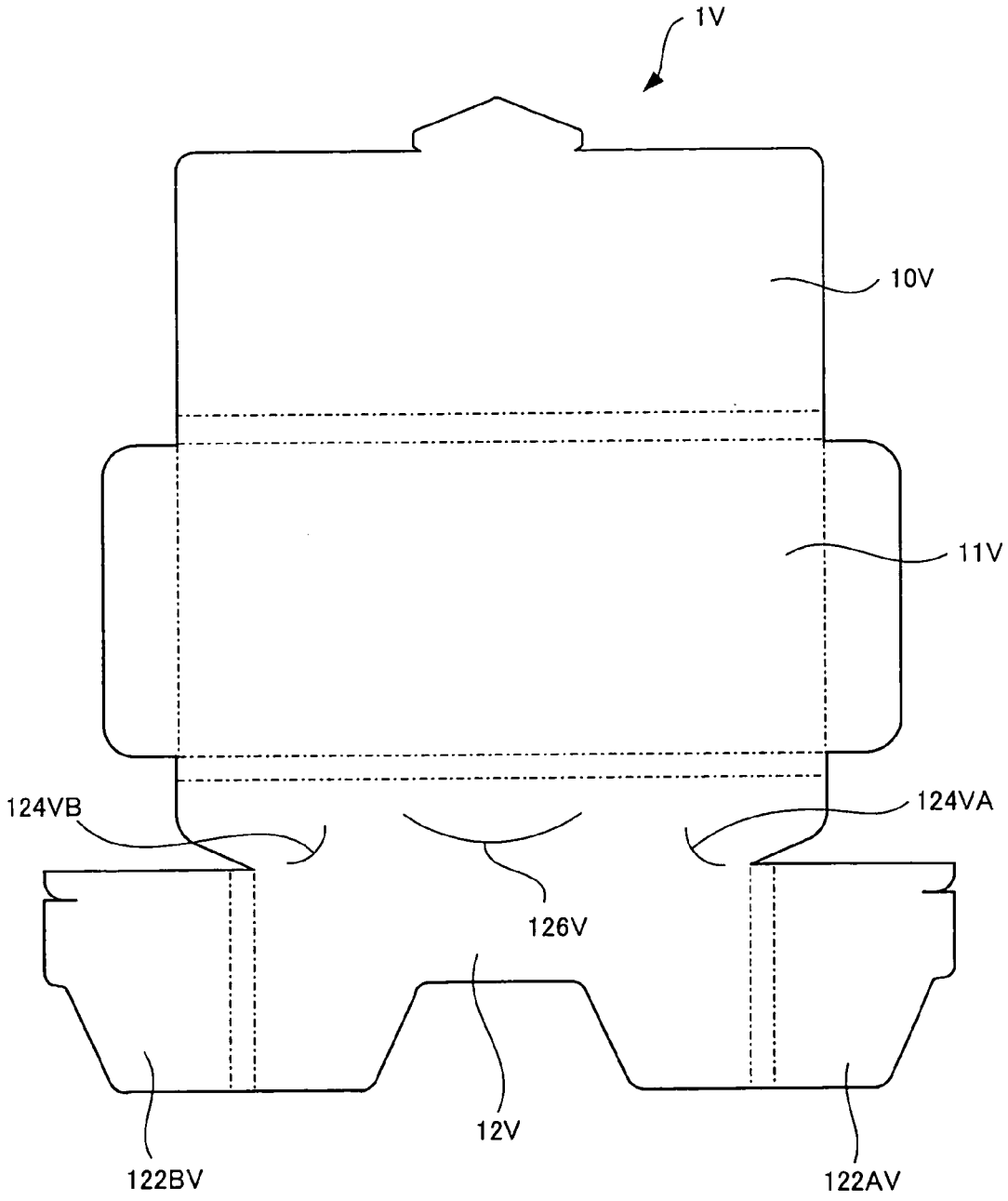
FIG. 8 shows another variation on FIG. 7.
Figure 9:
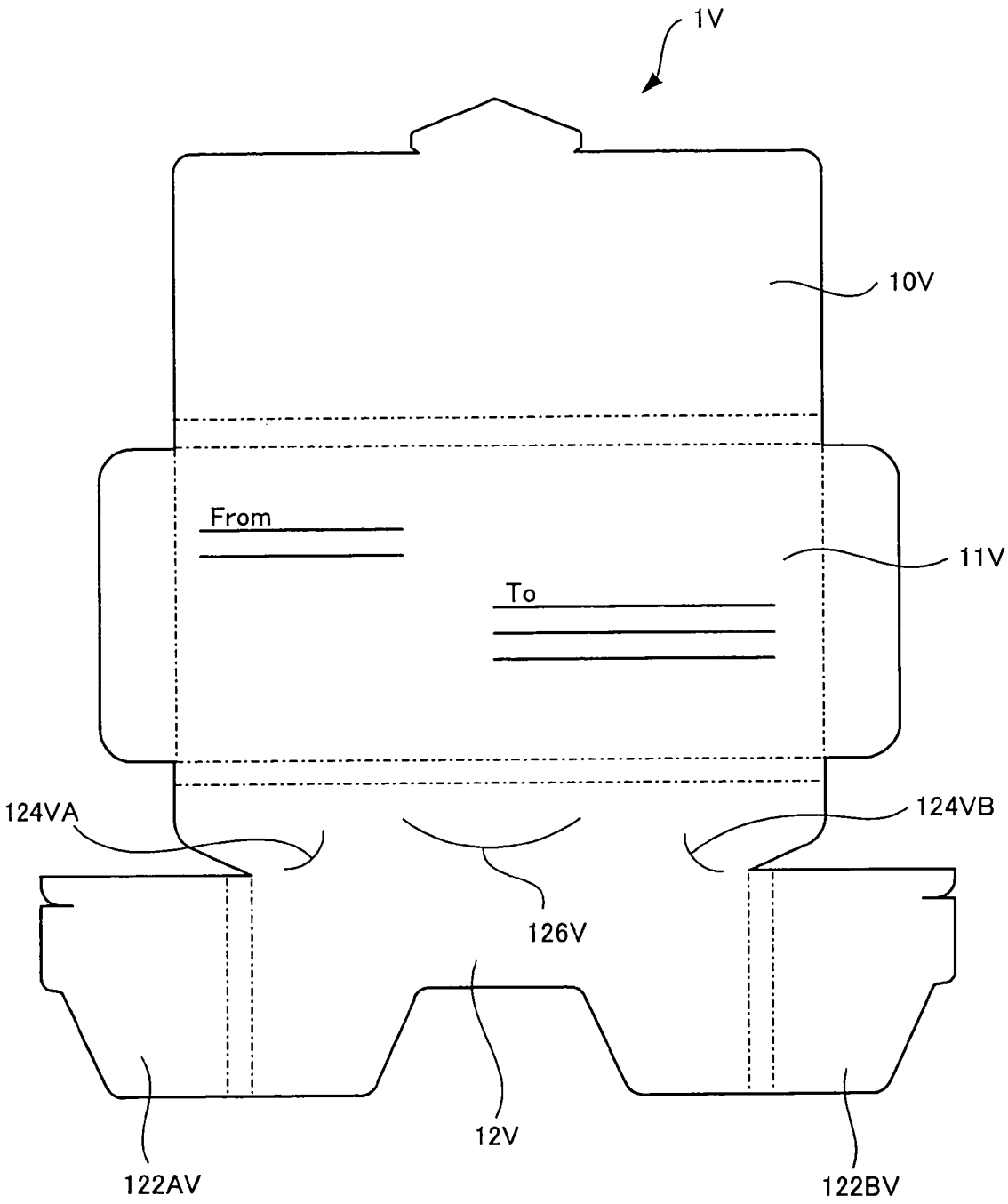
FIG. 9 shows another variation on FIG. 8.

FIGS. 7, 8 and 9 are variations of the photoprint storage bag of the present invention.

FIGS. 7 and 8 show the photoprint storage bag with the both lower ends of different shape, and FIG. 9 shows front description of the sealed letter, which is printed on the back of the central part, is changed from vertical to horizontal writing.

Considering that the development sheet for a photo print storage bag is also folded into a photo stand, it is desirable that the photo stands stably. To that end, FIG. 7 shows the example in which the height of a lower part 12M is set higher so that the lower part 12M can be used for a backrest of an L-sized photo, and slits 126M and 127M are provided in order to catch upper and lower ends of the photo. In addition, the shape of lower ends 122A and 122B shown in FIG. 1(*a*) and FIG. 1(*b*) are changed into the shape of 122AM and 122BM shown in FIG. 7 so that the photo stands stably. Consequently, when a photoprint storage bag is used as a photo stand, the lower part 12M as a whole works as a backseat of a photo, so that the photo stands stably. Further, variation on the shape of lower ends as in the lower ends 122AV and 122BV of FIG. 8 has similar effects. In addition, as variation on a sealed letter application, description on the front of the sealed letter that is printed on the back of a central part 11V can be horizontally written as shown in FIG. 9.

Such minor changes in the shape of the lower part of a pattern sheet and in the printed letters printed on a development sheet do not lead to cost increase. Therefore, a photoprint storage bag can still be manufactured at low cost.

What is claimed is:

1. A photoprint storage bag that stores a photoprint, the photoprint storage bag comprising:

a sheet folded into three in which a central part is superposed by an upper part and a lower part; wherein the lower part is provided with slits parallel to folds of the central part and the lower part, forming a photoprint storage section by folding inward both ends of the lower part; and the lower part is further provided with a pair of cuts enabling the photoprint storage bag to be used as a photo stand when both lower ends of a photoprint are inserted into the pair of cuts by a user, the pair of cuts are provided at a distance corresponding to a width of the photoprint; and each of the both ends of the lower part has an insertion cut into which an edge of the upper part is inserted when, in order to be used as a photo stand, the upper part and the lower part are folded toward the central part in a state that the both ends of the lower part are folded substantially perpendicular to a remaining lower part that is not folded with the both ends, wherein connection between the upper part and the lower part by the insertion of the edge of the upper part into the insertion cuts of the both ends of the lower part maintains a face of the remaining lower part, on which the photoprint is disposed, in a tilted position toward the central part.

2. A photoprint storage bag according to claim 1, wherein folding positions of the both ends of the lower part can be freely changed in accordance with the size of a photoprint to be stored.

3. A photoprint storage bag according to claim 1, wherein two pairs of cuts corresponding to postcard size and L size each of which is a typical size of a photoprint sheet are formed in the lower part.

4. A photoprint storage bag according to claim 1, wherein the central part is substantially the same size as a typical size of a sealed letter and a blank column to be filled with an address is provided on the central part.

* * * * *